US009802626B2

(12) United States Patent
Deng et al.

(10) Patent No.: US 9,802,626 B2
(45) Date of Patent: Oct. 31, 2017

(54) SUB-FRAME RADIAL BOGIE

(71) Applicant: CRRC MEISHAN CO., LTD., Meishan, Sichuan (CN)

(72) Inventors: Tao Deng, Sichuan (CN); Shuping Pan, Sichuan (CN); Aimin Wang, Suchuan (CN); Pu Wang, Suchuan (CN); Yungui Wang, Sichuan (CN); Hengli Li, Sichuan (CN); Xianfeng Zhang, Sichuan (CN); Hanjiang Luo, Sichuan (CN); Ji Zhu, Sichuan (CN); Zongquan Zhou, Sichuan (CN); Chengyong Liu, Sichuan (CN)

(73) Assignee: CRRC MEISHAN CO., LTD., Meishan, Sichuan (CN)

( * ) Notice: Subject to any disclaimer, the term of this patent is extended or adjusted under 35 U.S.C. 154(b) by 373 days.

(21) Appl. No.: 14/419,432

(22) PCT Filed: Apr. 4, 2013

(86) PCT No.: PCT/CN2013/073763
§ 371 (c)(1),
(2) Date: Feb. 3, 2015

(87) PCT Pub. No.: WO2013/181966
PCT Pub. Date: Dec. 12, 2013

(65) Prior Publication Data

US 2015/0210299 A1 Jul. 30, 2015

(30) Foreign Application Priority Data

Jun. 4, 2012 (CN) ..... 2012 1 0180507

(51) Int. Cl.
*B61F 5/04* (2006.01)
*B61F 5/38* (2006.01)
*B61F 5/28* (2006.01)

(52) U.S. Cl.
CPC ..... *B61F 5/04* (2013.01); *B61F 5/28* (2013.01); *B61F 5/38* (2013.01)

(58) Field of Classification Search
CPC ..... B61F 5/04; B61F 5/28; B61F 5/32; B61F 5/325; B61F 5/38
(Continued)

(56) References Cited

U.S. PATENT DOCUMENTS 4,537,138 A 8/1985 Bullock
5,794,538 A * 8/1998 Pitchford ..... B61F 5/32 105/218.1

FOREIGN PATENT DOCUMENTS

CH 634262 A5 1/1983
CN 1129181 A 8/1996
(Continued)

*Primary Examiner* — Zachary Kuhfuss
(74) *Attorney, Agent, or Firm* — Novick, Kim & Lee, PLLC; Allen Xue

(57) ABSTRACT

A sub-frame radial bogie comprises wheelsets, a side frame, a swing bolster, a wheelset radial device and a brake gear. Bearing adapters (41) forming the wheelset radial device are fixedly connected with the sub-frame (42) via pulling rivets (11), and each group of the bearing adapters (41) is bilaterally symmetrical in structure with a symmetry plane (A). The sub-frame (42) comprises an arm (51) and an end (52); a sub-frame connection hole (61) is arranged on the end (52); transverse positioning bosses (73) are arranged on the bearing adapters (41); and an arc groove (75) and symmetrical sub-frame connection holes (71) are arranged on a connection base (72). The bearing adapters use the same standard structure, hence, the more precise design and machining can be realized, and the cost is reduced, and meanwhile, the maintenance technique of the sub-frame is improved, and the maintenance cost is reduced.

5 Claims, 7 Drawing Sheets

(58) Field of Classification Search
USPC ..... 105/165, 167, 168
See application file for complete search history.

(56) References Cited

FOREIGN PATENT DOCUMENTS

| | | |
|---|---|---|
| CN | 201961326 U | 9/2011 |
| CN | 201961328 U | 9/2011 |

* cited by examiner

SUB-FRAME RADIAL BOGIE

FIELD OF THE INVENTION

The invention belongs to the railway transport equipment design and manufacturing field, in particular to the railway freight car bogie design and manufacturing field, and particularly relates to a sub-frame radial bogie for rolling stock.

DESCRIPTION OF THE RELATED ART

The bogie is a common structure of a railway freight car. For the railway freight car bogie, shear rigidity of the bogie is an important parameter affecting straight line operation stability thereof and can directly impact critical speed of hunting instability, operation stability and derailment safety of a rolling stock. Meanwhile, flexural rigidity is also an important parameter affecting curving performance of the bogie and can directly impact wheel wear rate and wheel-track force.

Before the twenty-first century, the freight car bogies mainly comprised common three-piece bogie and welded bogies. Despite the advantages of simple structure and convenient manufacturer and maintenance, the two types of bogies can not match the shear rigidity and flexural rigidity reasonably. Thus, critical speed and curving performance of rolling stocks can not be met at the same time, failing to meet the needs of high-speed economic development.

The sub-frame radial bogie is one of radial bogies. Its principle is installing a wheelset radical device between the front and rear wheelsets based on the three-piece bogie. The bogie inherits the features of original three-piece freight car bogie such as simple structure, convenient maintenance and strong adaptive capacity to curves. Besides, the front and rear wheelsets are connected by the wheelset radical device to kinematically couple two wheelsets of the bogie. Thus, the bogie has large shear rigidity and small flexural rigidity. For straight line operation, large shear rigidity of the wheelsets can ensure high critical hunting speed of rolling stocks, thus the rolling stocks have excellent straight line operation stability. When the rolling stocks pass through curves, small shear rigidity of the wheelsets is conducive to tending to radial position and enable rolling stocks to have excellent curving performance. The radial bogies have been accepted by railway freight transportation departments of various countries in the world due to excellent dynamic performance and curving performance. The radial bogies can bring multiplied economic benefits and are widely used.

A sub-frame radial bogie for a railway freight car in the prior art mainly comprises wheelsets, a side frame, a swing bolster, a wheelset radical device and a brake gear. As a core technology of the sub-frame radial bogie, a wheelset radial mechanism is mainly composed of a sub-frame, a connecting rod and a round pin. Two pairs of frames are arranged at the two wheelsets of the bogie respectively and connected with two connecting rods by round pins to form the wheelset radial mechanism. The sub-frame in the prior art consists of an adapter and an arm which are of integrally cast structure. In use, the sub-frame bears vertical, longitudinal and transverse loads. In order to ensure that the sub-frame has enough strength and rigidity, the adapter bearing part of the sub-frame needs large wall thickness and sectional area.

The wheelset radical device is installed on the basis of the original three-piece bogie, improving shear rigidity of the bogie greatly, reducing the flexural rigidity slightly, improving running speed, dynamics performance and curving performance of the rolling stock significantly, and meeting the application requirements of railway freight car such as speed-up and wear reduction. However, the arm and the adapter of the sub-frame radial bogie is of an integrally cast structure, which may have the following impacts. Firstly, in order to ensure that the sub-frame has enough strength and rigidity, casting weight thereof must be large as possible, and the adapter needs to match with the bearing, which requires high machining precision and increases processing difficulty. As a result, the production efficiency is affected, manufacturing cost is increased, and manufacturing quality can not be controlled easily. Secondly, as the adapter of the sub-frame is a wear part, the adapter can not be repaired conveniently after reaching wear limit and repair cost can be even increased.

Therefore, the defects of the wheelset radical device of the prior art comprise large dead weight of the sub-frame, high machining precision requirement, large processing difficulty, low production efficiency, high manufacturing cost, uncontrolled manufacturing quality, inconvenient repair in case of adapter wear, and increased repair cost.

SUMMARY OF THE INVENTION

The invention discloses a sub-frame radial bogie according to the defects of the prior art. The problem to be solved by the invention is to provide a split sub-frame radial bogie so as to realize high machining precision requirements of the wheelset radial device, improve production efficiency, reduce manufacturing cost, improve and stabilize manufacturing quality by split casting, combined fixation and further standardized sub-frame adapter structure. The invention can reduce repair cost in case of adapter wear.

The invention is realized by the following technical solution:

A sub-frame radial bogie, comprising wheelsets, a side frame, a swing bolster, a wheelset radical device and a brake gear, and characterized in that the wheelset radical device comprises a sub-frame, adapters and a connecting rod, and the sub-frame is fixedly connected with the adapters by pulling rivets.

The bogie has four groups of adapters with the same structure, and each group of adapters are structurally symmetrical at both sides of a symmetry plane, that is, each group of adapters have the same structure symmetrical at both sides of the symmetry plane.

The sub-frame comprises an arm and an end, and the end comprises two sub-frame connection holes for riveting the adapters.

The adapter has a connecting base and a transverse positioning boss riveted to the sub-frame.

The connecting base is provided with an arc groove at the bottom plane thereof, and comprises two adapter connection holes for riveting the sub-frame, and the two adapter connection holes are symmetrically arranged at both sides of a symmetry plane of the adapters respectively.

The sub-frame is connected with the connecting rod by a round pin.

The brake gear comprises a brake lever, a lower pull rod and a brake beam, and the central plane of the brake lever coincides with a longitudinal vertical plane of the car body.

Compared with the prior art, the invention has the following beneficial effects:

1 The sub-frame and the adapters are of split casting structure, thus greatly reducing dead weight of the assembled wheelset radial device, reducing unsprung weight of the bogie, effectively reducing wheel-rail dynamic interaction, and improving dynamics performance of the rolling stock.

2 The sub-frame is connected with the adapters by pulling rivets so that the sub-frame bears longitudinal and transverse loads only, which improves stress condition of the sub-frame and prolongs fatigue life thereof effectively.

3 The sub-frame is connected with the adapters by pulling rivets so that the adapters can be simply disassembled and replaced when the adapters reach wear limit, which improves the manufacturing and repair manufacturability of the sub-frame, and reduces manufacturing and maintenance costs thereof.

4 The adapter has standard structure which makes design and processing more precise, and reduces design and manufacturing costs.

5 The bogie is braked by a straight lever type single brake shoe, which can effectively improve brake efficiency of the bogie and entire rolling stock, and reduce wear of the shoe brake.

In the figures, 11 represents the pulling rivet, 12 represents the connecting rod, 13 represents the round pin, 21 represents sub-frame adapter of the prior art, 22 represents sub-frame of the prior art, 41 represents the adapter, 42 represents the sub-frame, 51 represents the arm, 52 represents the end, 61 represents the sub-frame connection hole, 71 represents the adapter connection hole, 72 represents the connecting base, 73 represents the positioning boss, 75 represents the arc groove, 81 represents the brake beam, 82 represents the brake lever, 83 represents the lower pull rod and A represents the symmetry plane.

DESCRIPTION OF THE PREFERRED EMBODIMENT

In order to make the object, technical solution and advantages of the invention more clear, the technical solution of the invention will be described clearly and completely in combination with accompanying drawings and examples. Obviously, the examples described herein are only part of examples of the invention rather than all examples. Based on the examples of the invention, all other examples obtained by those of ordinary skill in the art without creative work fall within the protection scope of the invention.

Figure 1:
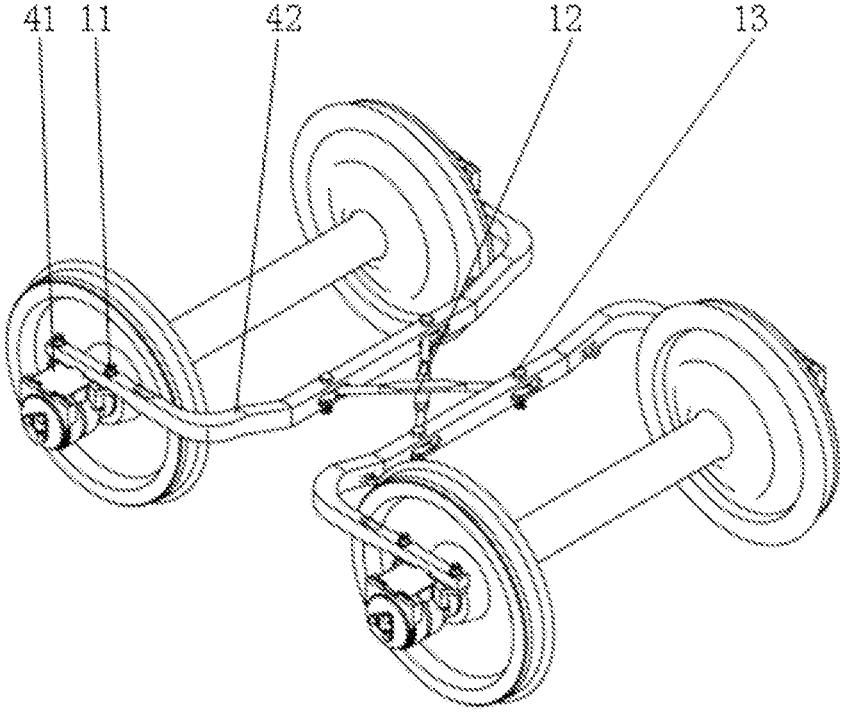
FIG. 1 is a structural diagram of the wheelset radial device of the invention arranged at the wheelset.
Figure 2:
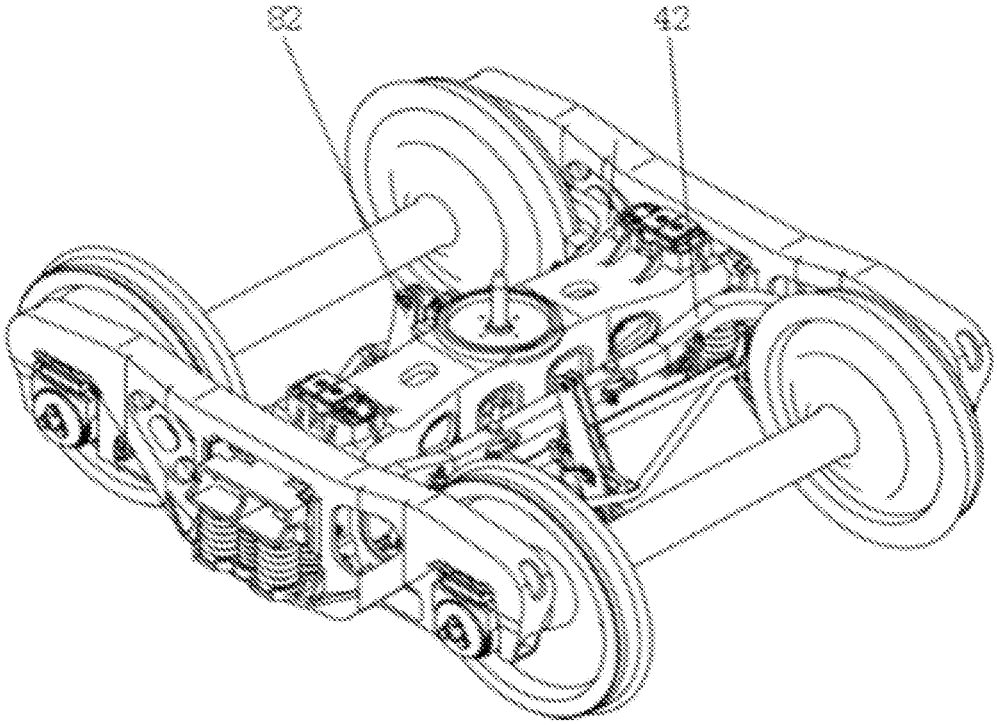
FIG. 2 is a structural diagram of the bogie of the invention.
Figure 3:
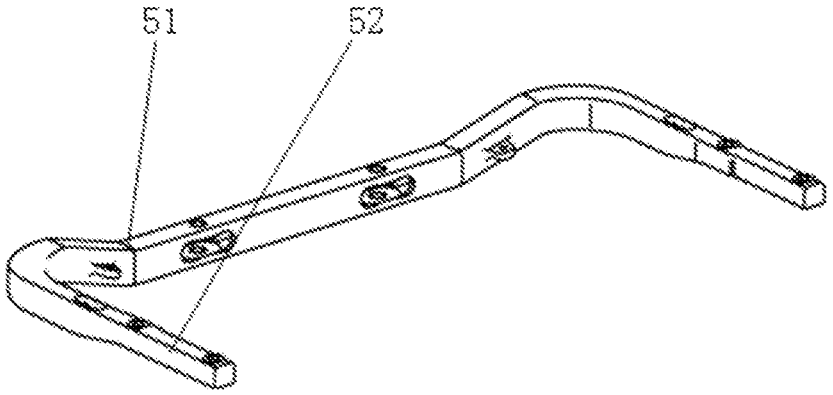
FIG. 3 is a structural diagram of the sub-frame of the invention.
Figure 4:
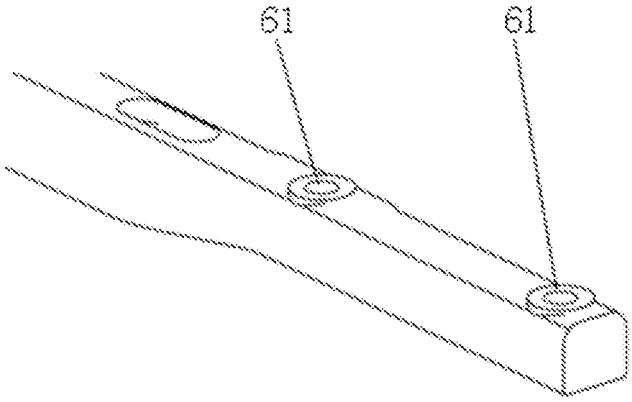
FIG. 4 is a partial structural diagram of the end of the sub-frame of the invention.
Figure 5:
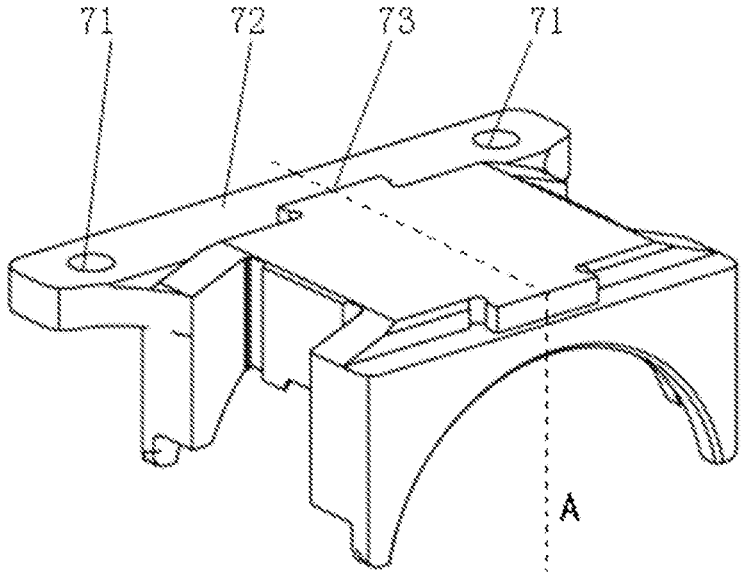
FIG. 5 is a structural diagram of the adapter of the invention.
Figure 6:
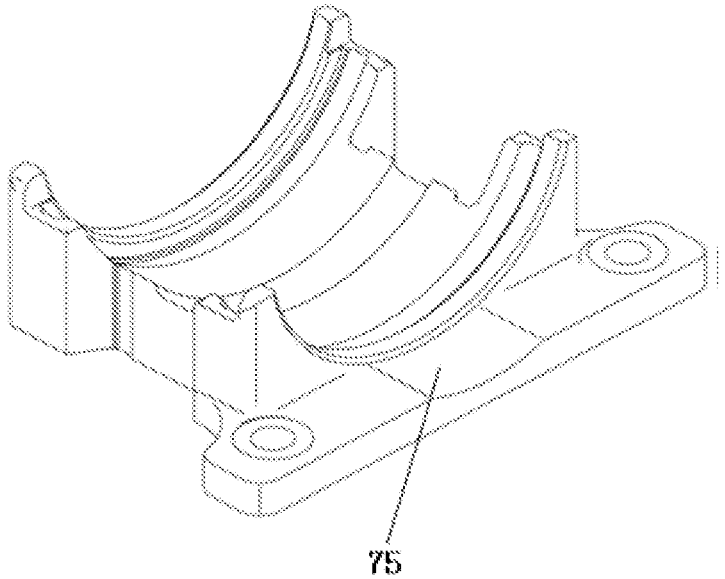
FIG. 6 is a structural diagram of the adapter of the invention in another direction.
Figure 7:
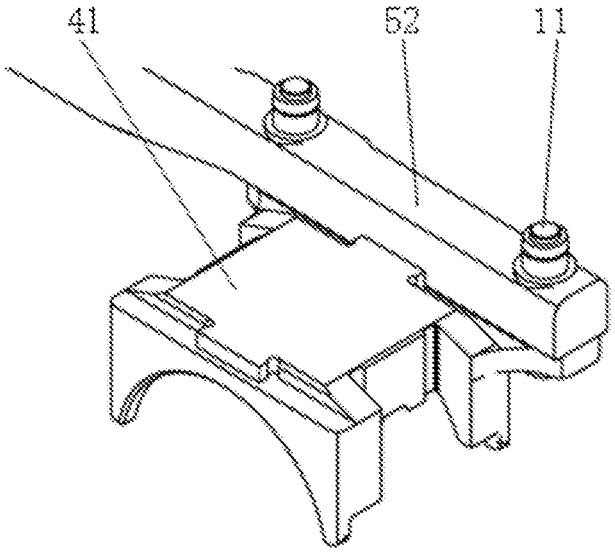
FIG. 7 is a partial structural diagram of the wheelset radial device of the invention.

FIG. 1 is a structural diagram of the wheelset radial device of the invention arranged at the wheelset, FIG. 2 is a structural diagram of the bogie of the invention, FIG. 3 is a structural diagram of the sub-frame of the invention, FIG. 4 is a partial structural diagram of the end of the sub-frame of the invention, FIG. 5 is a structural diagram of the adapter of the invention, FIG. 6 is a structural diagram of the adapter of the invention in another direction, and FIG. 7 is a partial structural diagram of the wheelset radial device of the invention.

In FIG. 1, two sub-frames 42 are connected with two crossed connecting rods 12 by round pins 13 at arms 51 of the sub-frames 42.

FIG. 2 comprises a wheelset, a side frame, a swing bolster, a wheelset radical device and a brake gear.

FIG. 3 and FIG. 4 show structure of the sub-frame 42 of the invention. The sub-frame 42 comprising the arm 51 and two ends 52, and is separately cast from the adapter of the sub-frame, which greatly reduces the technical difficulty of casting, improves casting precision, improves quality and precision of the wheelset radial device as a whole and reduces manufacturing cost. The end 52 comprises two sub-frame connection holes 61 for riveting the adapter 41.

FIG. 5 and FIG. 6 show the adapter 41 separately cast after disassembly. In the invention, the adapter 41 is designed as a structure symmetrical on a center symmetry plane A, and the structure unifies the adapters of the sub-frames of the wheelset radial device, which reduces design and manufacturing cost, facilitates standardized production, and improves efficiency and product quality. As shown in the figure, the adapter 41 has a connecting base 72 and a transverse positioning boss 73 for riveting the sub-frame 42, the connecting base 72 is provided with an arc groove 75 on the bottom plane thereof, the arc groove 75 can provide adequate clearance between the connecting base 72 of the adapter 41 and the bearing backstop after the bogie is installed and used, thus ensuring use safety of the bogie. The adapter 41 also comprises two adapter connection holes 71 for riveting the sub-frame 42, the two adapter connection holes 71 are symmetrically arranged at both sides of the symmetry plane A of the adapter 41, and the adapter connection holes 71 arranged symmetrically allow the adapter to adapt to four positions of the wheelset radial device.

FIG. 7 is a fixed structure for connecting the sub-frame 42 and the adapter 41. In the invention, the sub-frame is solidly connected with the adapter 41 by the pulling rivets 11 so that the adapter 41 can be disassembled conveniently when the adapter 41 reaches wear limit. The positioning boss 73 on the adapter 41 has good positioning action and is convenient and favorable for improving structure precision.

The invention is as shown in FIG. 1 to FIG. 8.

The example of the invention provides a sub-frame radial bogie, comprising a wheelset, a side frame, a swing bolster, a wheelset radical device and a brake gear. The wheelset radial device comprises a sub-frame 42, adapters 41, a connecting rod 12, pulling rivets 11 and a round pin 13, the sub-frame 42 is connected with the adapters 41 by pulling rivets, and the sub-frame 42 is connected with the connecting rod 12 by a round pin.

For the sub-frame 42, the integrated cast structure of the adapter and arm is cancelled; instead, the sub-frame 41 and the adapter 42 are separately cast and then subject to rivet connection, thus reducing weight of the wheelset radial device, improving manufacturing, repair manufacturability and precision of the sub-frame, and reducing manufacturing and maintenance cost of the bogie.

The sub-frame 42 comprises an arm 51 and an end 52, and the end 52 of the sub-frame further comprises two first sub-frame connection holes 61 for riveting the adapter 41.

The adapter 41 is cast with a connecting base 72 and a transverse positioning boss 73 for riveting the sub-frame 42.

The connecting base 72 is provided with an arc groove 75 on the bottom plane thereof, which provides adequate clearance between the connecting base of the adapter and the bearing backstop after the bogie is installed and used, thus ensuring use safety of the bogie. The connecting base 72 also comprises two adapter connection holes 71 for riveting the sub-frame 42, which are symmetrically arranged at both sides of the center symmetry plane A of the adapter surface.

For the bogie in the examples of the invention, when the sub-frame 42 is riveted with the adapter 41, the horizontal plane of the connecting base 72 of the adapter 41 is adapted to the bottom surface of the end of the sub-frame 42, then the transverse positioning boss 73 of the adapter 41 is propped against the lateral surface of the end 52 of the sub-frame 42 to align the sub-frame connection hole 61 with the adapter connection hole 71, through which the pulling rivets can pass for fastening. After the sub-frame 42 is riveted with the adapter 41, the connecting line of two sub-frame connection holes 61 is parallel to longitudinal center line of the side frame, and two holes are symmetrical about the center line of the axle. In order to ensure dimensional precision after the sub-frame 42 is riveted with the adapter 41, preferably diameter size of all connection holes is 1 mm-1.5 mm larger than that of the pulling rivets.

Figure 8:
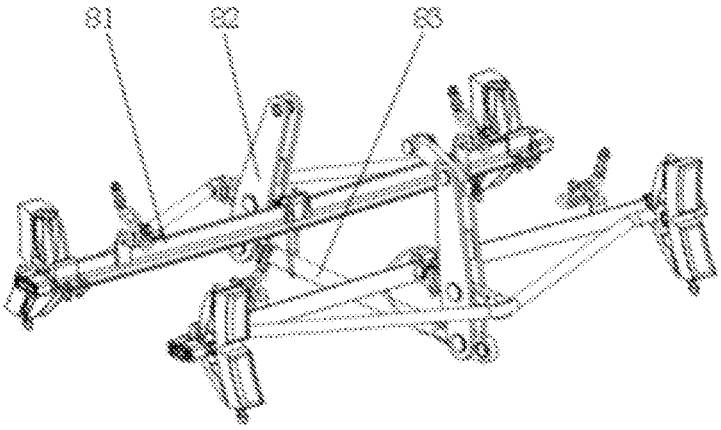
FIG. 8 is a structural diagram of the brake gear of the invention.

As shown in FIG. 8, for the bogie in the example, the brake gear preferably comprises a brake lever 82, a lower pull rod 83 and a brake beam 81, and the central plane of the brake lever 82 coincides with longitudinal plane of symmetry of the car body.

For the bogie in the example of the invention, two pieces of levers are welded as a whole to form the brake lever 82.

The sub-frame radial bogie of the invention solves the problems of large deadweight of the sub-frame, high machining precision, large processing difficulty, low production efficiency and high manufacturing cost. Thus, manufacturing quality thereof can be controlled easily. The sub-frame is connected with the adapter by pulling rivets, so that the adapter can be simply disassembled and replaced when the adapter reaches wear limit, which improves the manufacturing and repair manufacturability of the sub-frame, and reduces manufacturing and maintenance cost of the bogie.

Figure 9:
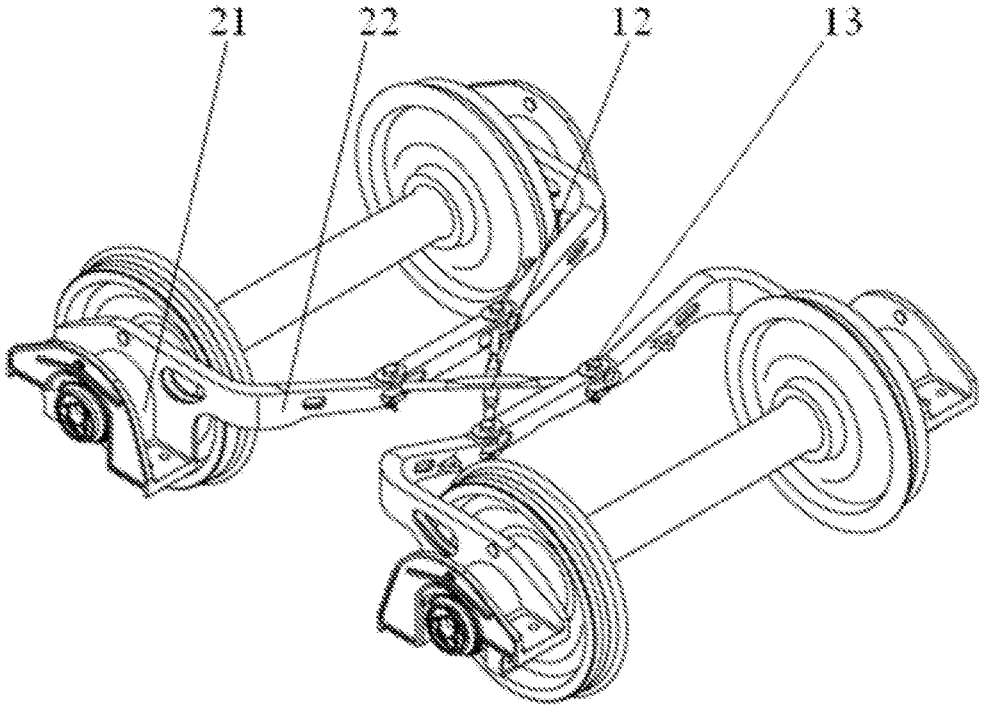
Prior Art Fig. 9
FIG. 9 is a structural diagram of the wheelset radial mechanism in the sub-frame radial bogie of the prior art.
Figure 10:
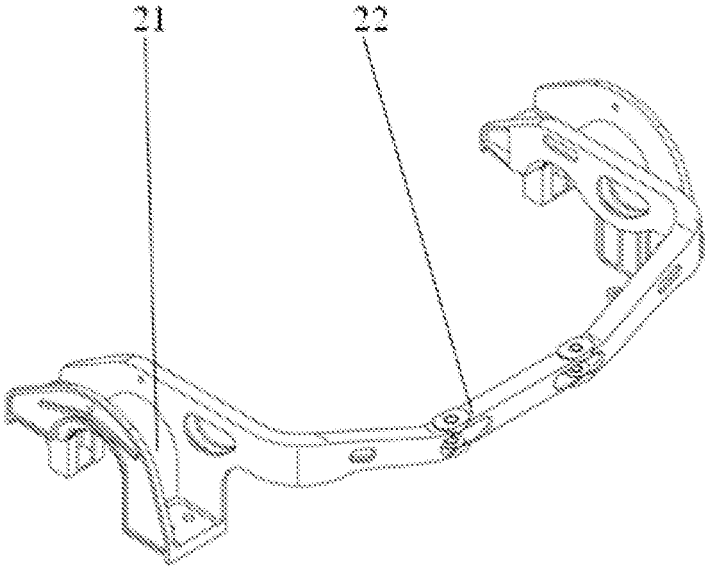
Prior Art Fig. 10
FIG. 10 is a structural diagram of the sub-frame in the sub-frame radial bogie of the prior art.

FIG. 9 is a structural diagram of the wheelset radial mechanism in the sub-frame radial bogie of the prior art, and FIG. 10 is a structural diagram of the sub-frame in the sub-frame radial bogie of the prior art. As shown in the figures, the wheelset radial mechanism in the sub-frame radial bogie of the prior art is machined after integrated casting. The sub-frame adapter 21 is an asymmetric structure.

It should be understood that the examples above are only considered to be illustrative for the technical solution of the invention instead of limitation thereto. Although the invention is described in detail in combination with the examples, those of ordinary skill in the art shall understand that they still can modify technical solutions documented in the examples or perform equivalent replacement on some technical features, but such modifications or replacements shall not allow the nature of corresponding technical solutions to depart from spirit and scope of the invention.

The invention claimed is:

1. A sub-frame radial bogie, comprising a set of four wheels, a side frame, a swing bolster, a wheel set radial device, and a brake gear, wherein the wheel set radial device comprises a pair of sub-frames, four bearing adapters, each configured to be mounted on a bearing of one of the four wheels, and a pair of connecting rods connecting the pair of sub-frames (12), and each sub-frame is fixedly connected with two of the bearing adapters by rivets, and wherein each sub-frame comprises an arm and an end, and the end has two sub-frame connection holes for riveting one bearing adapter, wherein the bearing adapter comprises a connecting base having a horizontal surface for receiving the end of the arm and a transverse positioning boss propped against a lateral surface of the end.

2. The sub-frame radial bogie according to claim 1, wherein the four adaptors have a same structure.

3. The sub-frame radial bogie according to claim 1, wherein the connecting base is provided with an arc groove on the side of the connecting base facing the wheel bearing, and comprises two adapter connection holes for riveting the end of the sub-frame.

4. The sub-frame radial bogie according to claim 3, wherein the sub-frame is connected with the connecting rod by a round pin.

5. The sub-frame radial bogie according to claim 3, wherein the brake gear comprises a brake lever, a lower pull rod and a brake beam, and the central plane of the brake lever coincides with longitudinal plane of symmetry of the sub-frame radial bogie, wherein the brake lever has two pieces of levers welded together.

* * * * *